US007643778B2

(12) United States Patent
Brown et al.

(10) Patent No.: US 7,643,778 B2
(45) Date of Patent: Jan. 5, 2010

(54) POWDER TRANSPORT WITH A TAPERED FEED ROLLER OF AN ELECTROSTATOGRAPHIC PRINTER

(75) Inventors: Kenneth J. Brown, Penfield, NY (US); Laverne N. Lincoln, Jr., Macedon, NY (US)

(73) Assignee: Eastman Kodak Company, Rochester, NY (US)

( * ) Notice: Subject to any disclaimer, the term of this patent is extended or adjusted under 35 U.S.C. 154(b) by 291 days.

(21) Appl. No.: 11/742,092

(22) Filed: Apr. 30, 2007

(65) Prior Publication Data

US 2009/0052950 A1 Feb. 26, 2009

(51) Int. Cl.
*G03G 15/09* (2006.01)

(52) U.S. Cl. ..... 399/272; 399/281

(58) Field of Classification Search ..... 399/272, 399/281, 282, 260; 492/27, 30, 36; 222/DIG. 1
See application file for complete search history.

(56) References Cited

U.S. PATENT DOCUMENTS 4,518,245 A * 5/1985 Bares ..... 399/272
4,671,207 A * 6/1987 Hilbert ..... 399/272 X
4,786,936 A * 11/1988 Ikegawa et al. ..... 399/272
5,260,159 A 11/1993 Ohtani et al. ..... 430/108.24
5,570,170 A 10/1996 Muranyi et al. ..... 399/262
5,708,852 A 1/1998 Aebli et al. ..... 710/65
5,737,677 A 4/1998 Tombs et al. ..... 399/296
5,794,111 A 8/1998 Tombs et al. ..... 399/302
5,926,679 A 7/1999 May et al. ..... 399/296
6,026,265 A * 2/2000 Kinoshita et al. ..... 399/281
6,507,721 B1 * 1/2003 Yergenson et al. ..... 399/281
6,571,077 B2 * 5/2003 Thompson et al. ..... 399/272 X
2005/0008402 A1 * 1/2005 Mizutani et al. ..... 399/281
2008/0112732 A1 * 5/2008 Stelter et al. ..... 399/272

FOREIGN PATENT DOCUMENTS

JP 07-271178 A * 10/1995
JP 2000-112224 A * 4/2000
JP 2006-258955 A * 9/2006

* cited by examiner

*Primary Examiner*—Sophia S Chen
(74) *Attorney, Agent, or Firm*—Donna P. Suchy

(57) ABSTRACT

An apparatus and method for dispensing toner in an electrostatographic printer includes an apparatus for feeding powder toward the feed apparatus wherein the feed roller includes a tapered feed roller including a shaft and one or more variable height flutes such that there is more developer volume in the direction of flow as well as a conveyance controller for controlling the powder conveying device, including the one or more tapered feed rollers such that the tapered feed roller preferentially uniformly conveys the powder toward the feed apparatus.

15 Claims, 6 Drawing Sheets

POWDER TRANSPORT WITH A TAPERED FEED ROLLER OF AN ELECTROSTATOGRAPHIC PRINTER

FIELD OF THE INVENTION

The invention relates to electrographic printers and apparatus thereof. More specifically, the invention is directed to an apparatus and method for transporting a powder, such as developer to an image device in an electrostatographic printer.

BACKGROUND OF THE INVENTION

Electrographic printers and copiers utilizing developer comprising toner, carrier, and other components use a developer mixing apparatus and related processes for mixing the developer and toner used during the printing process. The term "electrographic printer," is intended to encompass electrophotographic printers and copiers that employ dry toner developed on an electrophotographic receiver element, as well as ionographic printers and copiers that do not rely upon an electrophotographic receiver. The electrographic apparatus often incorporates an electromagnetic brush station or similar development station, to develop the toner to a substrate (an imaging/photoconductive member bearing a latent image), after which the applied toner is transferred onto a sheet and fused thereon.

As is well known, a toner image may be formed on a photoconductor by the sequential steps of uniformly charging the photoconductor surface in a charging station using a corona charger, exposing the charged photoconductor to a pattern of light in an exposure station to form a latent electrostatic image, and toning the latent electrostatic image in a developer station to form a toner image on the photoconductor surface. The toner image may then be transferred in a transfer station directly to a receiver, e.g., a paper sheet, or it may first be transferred to an intermediate transfer member or ITM and subsequently transferred to the receiver. The toned receiver is then moved to a fusing station where the toner image is fused to the receiver by heat and/or pressure.

In electrostatographic copiers and printers, pigmented thermoplastic particles, commonly known as "toner," are applied to latent electrostatic images to render such images visible. Often, the toner particles are mixed with and carried by somewhat larger particles of magnetic material. During the mixing process, the magnetic carrier particles serve to triboelectrically charge the toner particles to a polarity opposite that of the latent charge image. In use, the development mix is advanced, typically by magnetic forces, from a sump to a position in which it contacts the latent charge image. The relatively strong electrostatic forces associated with the charge image operate to strip the toner from the carrier, causing the toner to remain with the charge image. Thus, it will be appreciated that, as multiple charge images are developed in this manner, toner particles are continuously depleted from the mix and a fresh supply of toner must be dispensed from time-to-time in order to maintain a desired image density. Usually, the fresh toner is supplied from a toner supply bottle mounted upside-down, i.e., with its mouth facing downward, at one end of the image-development apparatus. Under the force of gravity, toner accumulates at the bottle mouth, and a metering device, positioned adjacent the bottle mouth, operates to meter sufficient toner to the developer mix to compensate for the toner lost as a result of image development. Usually, the toner-metering device operates under the control of a toner concentration monitor that continuously senses the ratio of toner to carrier particles in the development mix.

It is well known that toner is a powdery substance that exhibits a considerable degree of cohesiveness and, hence, relatively poor flowability. Since the force of gravity alone does not usually suffice in causing toner to flow smoothly from the mouth of an inverted toner bottle, other supplemental techniques have been used to "coax" the toner from the bottle. For example, flow additives, such as silica and the like, have been added to the mix to reduce the troublesome cohesive forces between toner particles. See, e.g., the disclosure of U.S. Pat. No. 5,260,159 in which a "fluidization" agent is added to a developer mix in a development sump to assist the movement of developer therein. While beneficial to a more consistent flow of developer, such substances influence other performance attributes of the development process and their effectiveness is therefore constrained.

Development stations require replenishment of toner into the developer sump to replace toner that is deposited on the photoconductor or receiver as well as a magnetic carrier that are mixed together uniformly to form an effective developer. The developer must be mixed and transported to a position where it can be in contact with the latent charged image. If the mixing and/or transport are inefficient or ineffective the printing process is compromised. This can lead to many problems from poor prints to a no prints at all. In electrostatic development stations utilizing carrier, this is especially challenging since the magnetic carrier is affected by many conditions including particle size and orientation. Although the developer can stay near the feed roller at the front of the roller, as the developer with the feed roller encounters an increasing magnetic field is imposed on the developer is attracted away from the feed roller. As the feed apparatus picks up developer from the feed roller the amount of developer left near the rear portion of the feed roller is greatly decreased to the point where there is no developer left to transport to the latent charge image and printing stops. This is not an easy problem to solve since a simple change in developer amount or charge can quickly change conditions within the feed channel. This problem is enhanced since when there is less developer left in the feed channel then the pick-up point becomes even further from the feed roller and since the magnetic force is decreased by multiples as the distance decreases this makes the problem quite significant.

The present invention corrects the problem of non-uniform transport of developer from the feed roller to the feed apparatus. The apparatus and related methods described correct the problem of non-uniform developer feed in order to allow the printer to produce the high quality prints or powder coatings required by consumer demand. The following invention solves the current problems with developer feed rollers and will work in a wide variety of situations and with different types of toners, powders, or particles.

SUMMARY OF THE INVENTION

The invention is in the field of electrographic printers and powder coating systems. More specifically, the invention relates to an apparatus and method for feeding powder toward a feed apparatus wherein the feed roller includes a tapered feed roller comprising a shaft and one or more variable height flutes such that there is more developer volume in the direction of flow as well as a conveyance controller for controlling the powder conveying device. The tapered feed roller preferentially uniformly conveys the powder toward the feed apparatus. The apparatus for transporting powder into a developer station containing at least powder and magnetic carrier including a conveyance housing and the one or more tapered feed rollers with flutes of some specific volume per unit length, along with a stationary magnet in the core of the roller that urges developer into the flute volume.

DETAILED DESCRIPTION OF THE INVENTION

Figure 1:
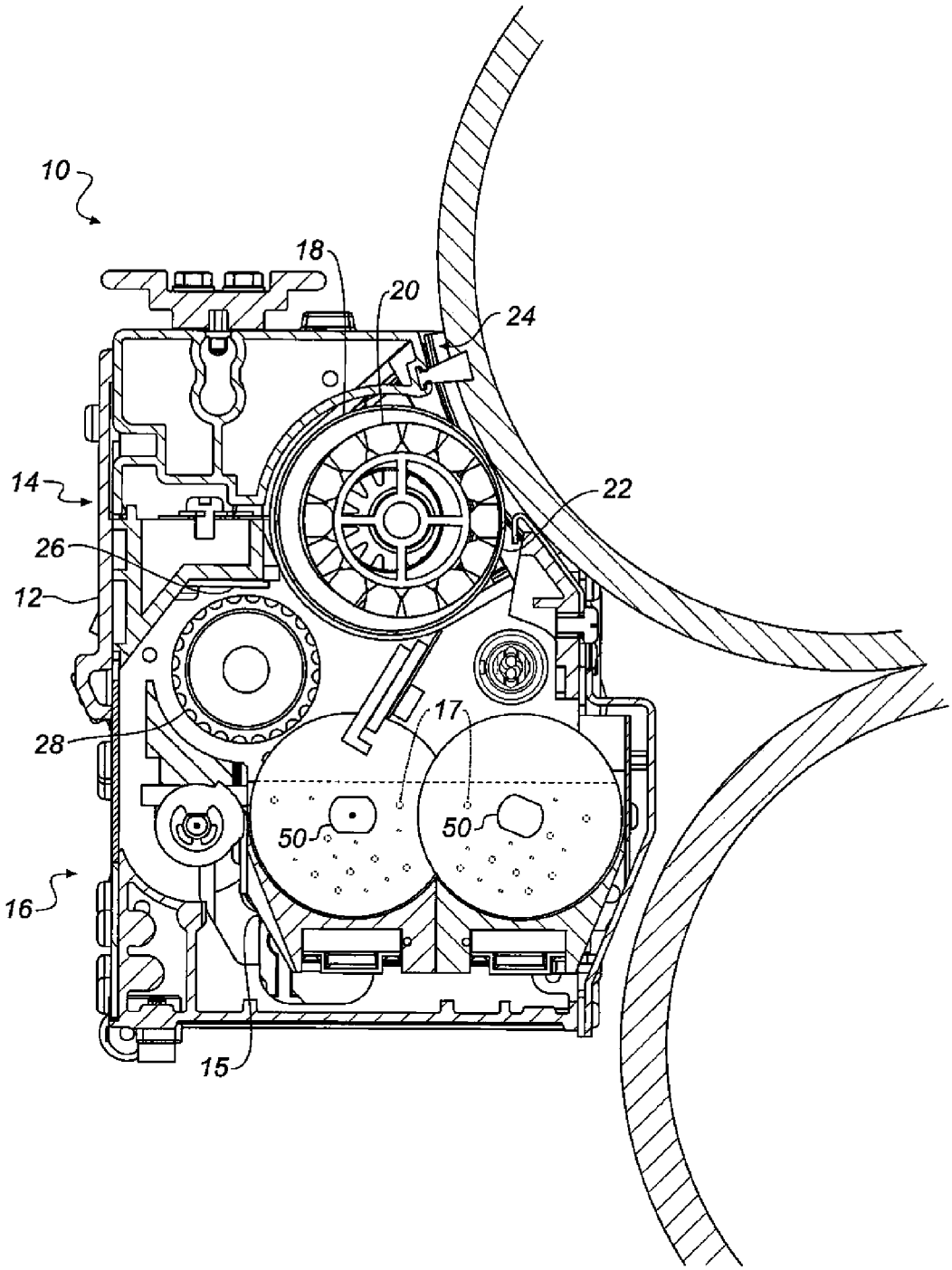
FIG. 1 is a side elevational view, in cross-section, of a reproduction apparatus magnetic brush developer station according to this invention.

FIG. 1 shows an electrostatic printer magnetic brush developer station, according to this invention, sometimes simply referred to as a developer station, designated generally by the numeral 10. The development station housing 12 encloses a feed apparatus 14 and a powder conveyance device 16 and forms, in part, a reservoir 15 for developer material 17 comprising a powder and a carrier material. A development roller 18 is mounted within the development station housing 12. The development roller 18 includes a rotating (shown as counterclockwise in FIG. 1) fourteen-pole core magnet 20 inside a rotating (shown as clockwise in FIG. 1) shell 22. The core magnet 20 and the shell can have many other suitable relative rotations as is known in the art.

The quantity of developer material delivered from the reservoir 15 to the development zone 24 is controlled by a metering skive 26, positioned parallel to the longitudinal axis of the development roller 18, at a location upstream in the direction of shell rotation prior to the development zone. The metering skive 26 extends the length of the development roller 18 (see FIG. 3). The core magnet 20 does not extend the entire length of the development roller; as such, the developer nap on the shell 22 does not extend to the end of the development roller. The development station 12 houses one or development rollers to move the developer material within the reservoir of the housing 12 from the mixing area to the feed apparatus.

Figure 2A:
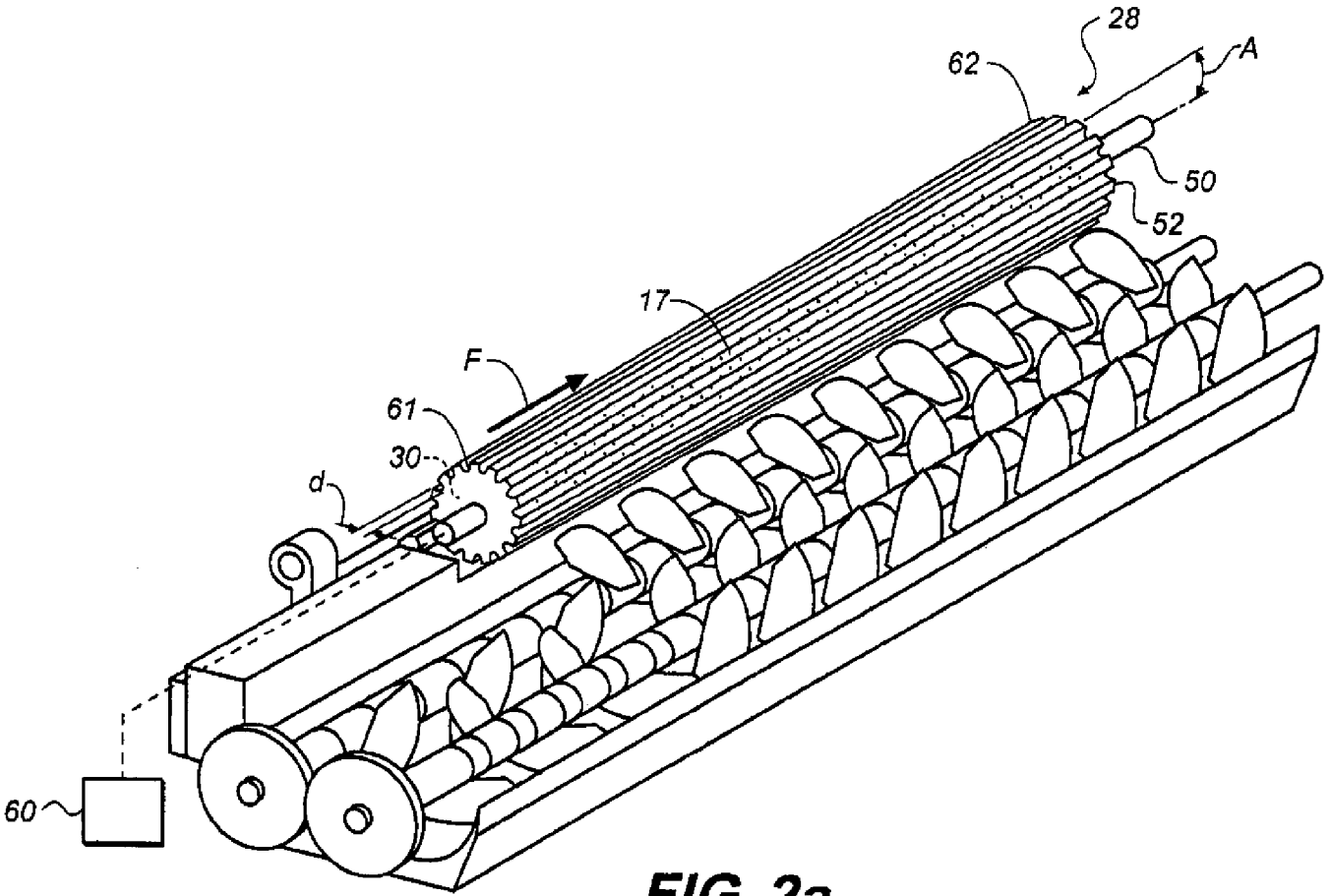
FIGS. 2*a* and 2*b* show a tapered roller of the magnetic brush development station of FIG. 1.
Figure 2B:
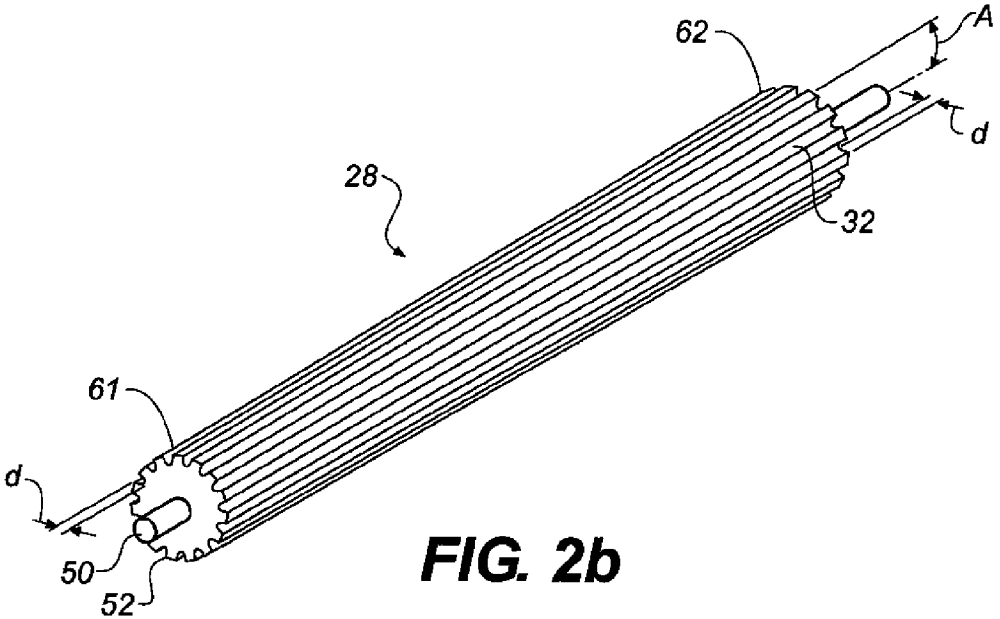

FIGS. 2*a* and 2*b* show one or more tapered feed rollers 28 (only one is shown for clarity) each having a shaft 50 and one or more variable height flutes 52 such that there is more developer volume between the flutes as the developer moves in the direction of flow (F). Generally, the feed roller has a rotating outer shell and flutes that can move some specific volume of developer 17 per unit length, along with a stationary magnet 30 in the core of the roller that urges developer 17 into the flute volume 32, as shown in FIGS. 2*b*. FIG. 2*a* shows a feed roller flute height 'd' increasing in the direction of the developer flow (F). This is sometimes referred to as volume bias. Developer feed uniformity is improved by creating a variable flute height 'd' on the feed roller. This can be accomplished by machining a taper on a constant height flute roller as shown in FIG. 2*b*.

The magnetic brush development station 10, according to this invention, uses two augers (see FIG. 1), although a different number could be used in conjunction with the tapered roller. Controller 60 controls the development station including the tapered feed roller 28 as shown in FIG. 2*g*. The controller also controls the powder-conveying device, such that the auger preferentially mixes in the mixing space and transports in the second transport space as the powder is conveyed toward the tapered rollers 28 as shown in FIG. 1. The tapered rollers 28 described above allow more developer volume between the flutes 52 as the developer moves in the direction of flow (F).

Figure 3A:
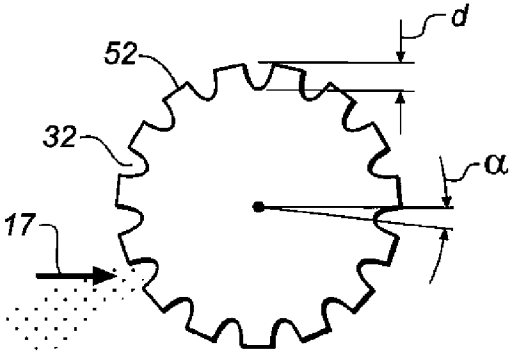
FIGS. 3*a*-3*b* are schematics of a portion of the tapered roller of FIG. 2, particularly showing other embodiments according to this invention.
Figure 3B:
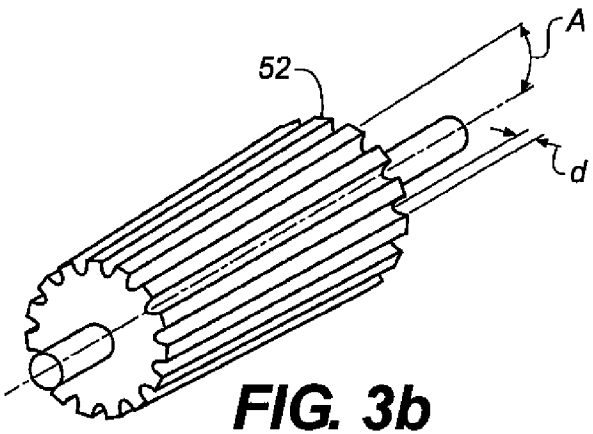

Developer feed uniformity is improved by tapering the feed roller. In one embodiment this is achieved using the variable flute height 'd' on the feed roller as shown in FIG. 2*b* and discussed above. This can also be accomplished by varying other features of the tapered feed roller as shown in the two embodiments shown in FIGS. 3*a* and 3*b* that result in developer feed uniformity and specifically encourage more developer in areas or greater pickup, such as at the second end. FIGS. 3*a* and 3*b* show a flute 52 with an internal angle $\alpha$ and a flute angle tilt $\beta$ on individual flutes as well as the flute height 'd'. Theses features could be combined or used separately to control the volume bias as required. The flutes 52 can also have one or more surface features, such as texture or pockets that might effectively create a bucket type effect, to further move the volume of developer moved toward the feed apparatus.

Figures 4A, 4B:
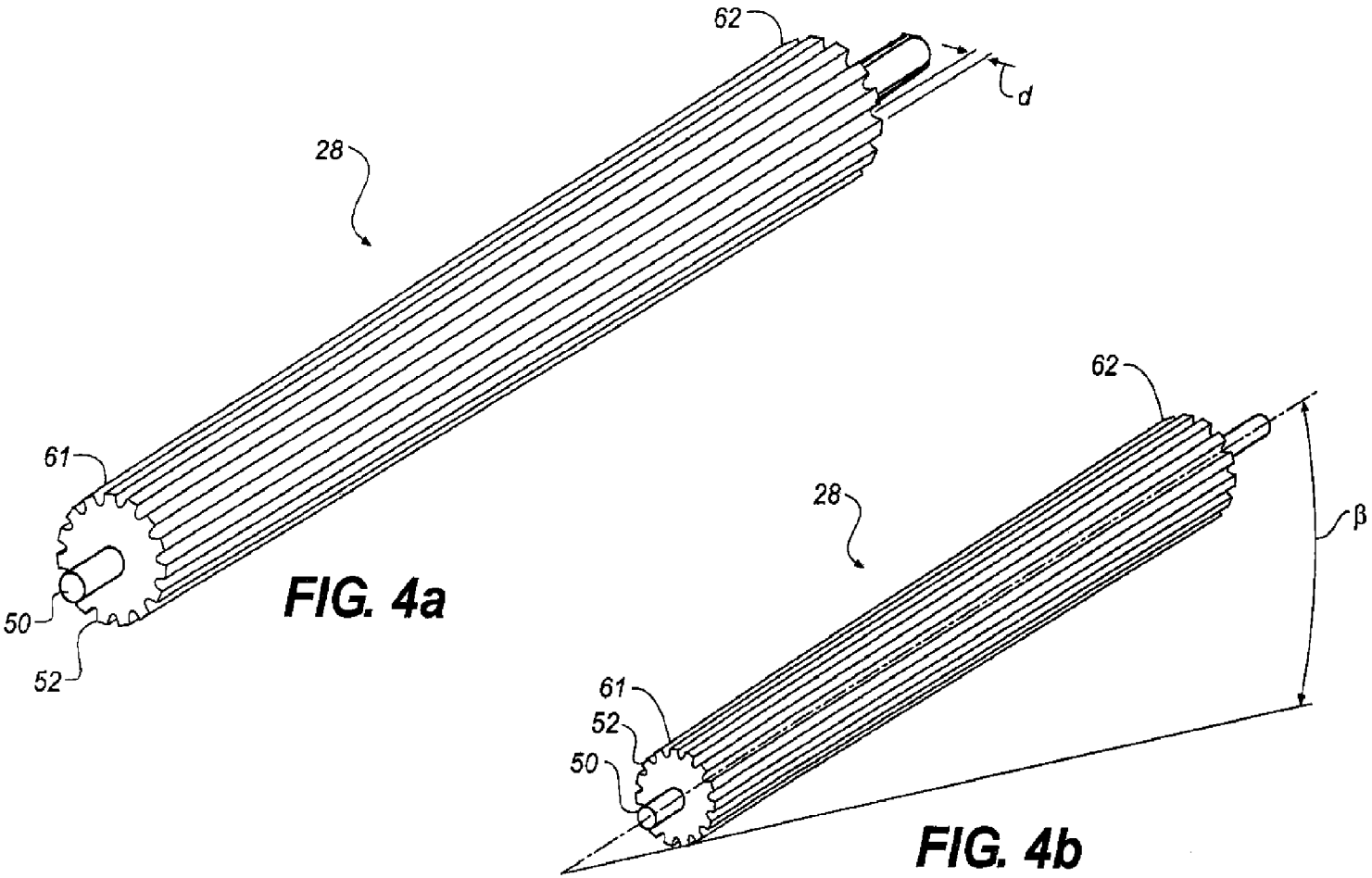
FIGS. 4*a*-4*b* are schematics of a portion of the tapered roller of FIG. 2, particularly showing other embodiments according to this invention.

Other embodiments as shown in FIGS. 4*a* and 4*b* can be used to increase the relative volumes of developer traveling in direction F. These include tapering the shaft diameter or support diameter and/or sloping the whole taper feed roller shaft the required amount to effect the desired total volume increase. This can be done by machining a taper on the flute shaft or cylinder or some other similar method as shown in FIG. 3. This variable height is oriented such that the flute height 'd' increases in the direction of the developer flow (F) in the channel. Since during operation there is normally more developer at the second or rear end 62 of the feed roller than in the front end 61, as shown in FIG. 3. The tapered rollers compensate for this effect. This is important since when there is less developer left in the feed channel the pick-up point at the surface of the developer in the channel becomes even further from the feed roller. The tapered feed roller allows the lead edge of the feed roller to hold less developer, thereby allowing more developer to move to the rear 62 of the channel resulting in more uniform pick-up by the feed apparatus and thus more efficient and higher quality prints.

Figure 5:
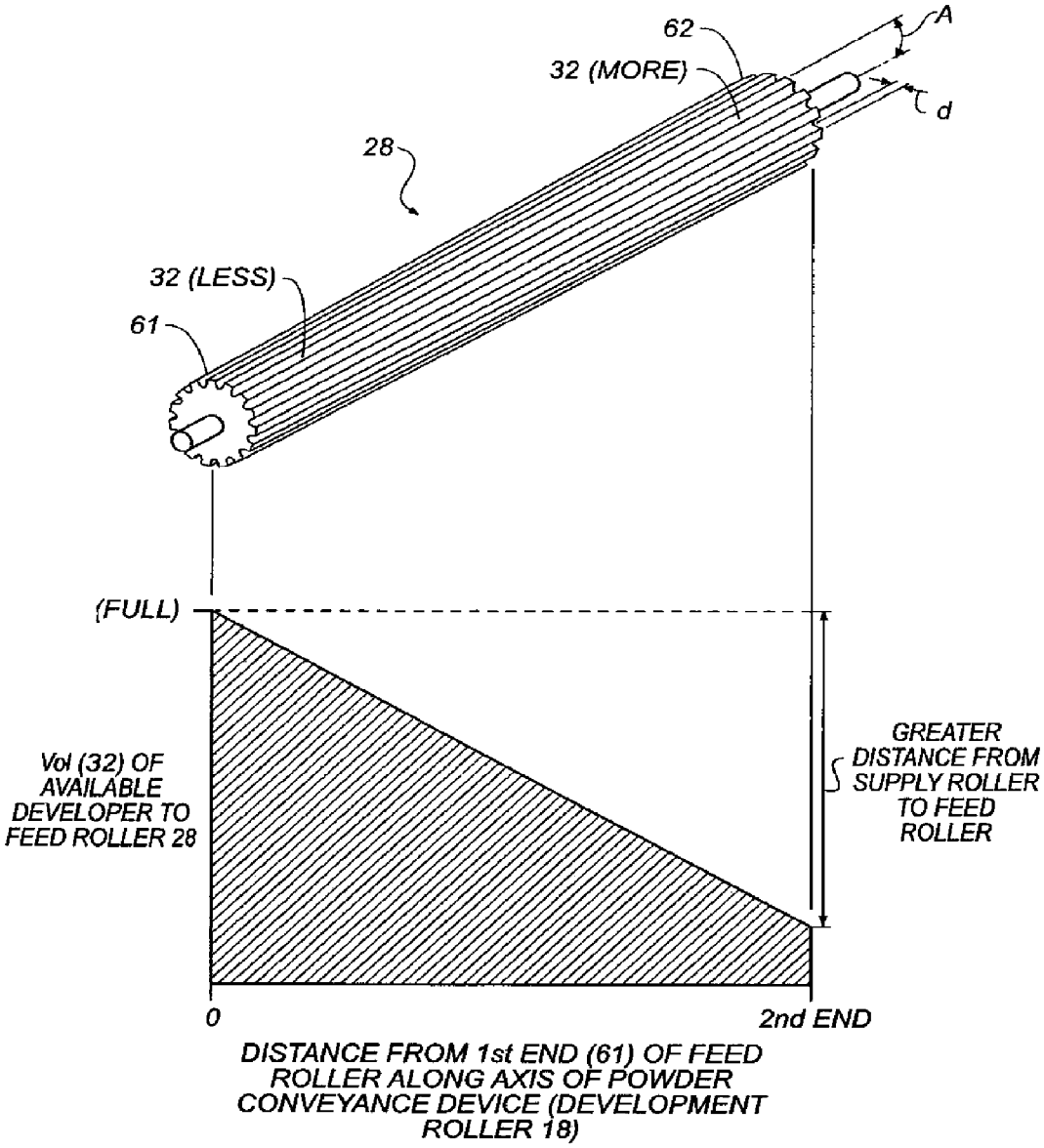
FIG. 5 is a schematic of a portion of the reproduction apparatus magnetic brush developer station according to this invention.

FIG. 5 shows the developer moving from the first end 61 of the tapered roller 28 to the second end 62 of the tapered roller 28. The volume of developer at the first end does not normally equal the volume at the second end since there is more space up at the second end but the present invention does try to minimize that difference so that the percent fill (or ratio of a powder volume to total volume) at the first end 61 or first location approaches that at the second end 62 or at a second location. in the feed roller as the powder is conveyed toward the development zone 24 as shown in FIG. 1.

Figure 6:
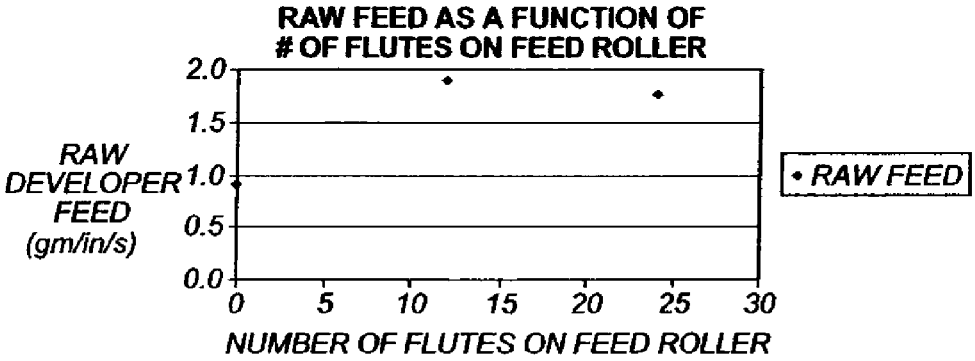
FIG. 6 shows the number of flutes and how it influences the amount of developer feed in the direction of the developer flow.
Figure 7:
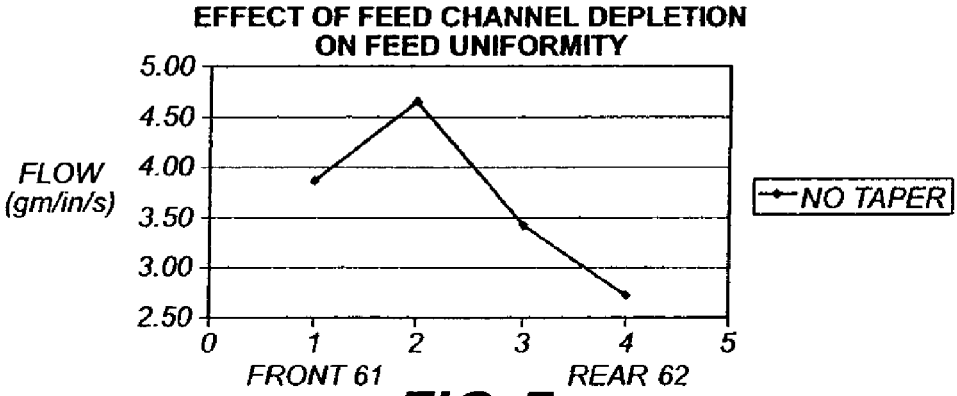
FIG. 7 shows the channel depletion effect.

The addition of these flutes 52 on the feed roller shaft 50 helps urge and keep the developer on the feed roller until such time where the imposed magnetic field of the toning roller would attract the developer to it. This effect is shown in FIG. 6. FIG. 6 shows the number of flutes 52 and how it influences the amount of developer feed in the direction of the developer flow. Note that the feed is increased approximately 2 times when the number of flutes increase from 0 flutes (a bare roller) to 12 flutes. As discussed above, when a non-tapered feed roller picks up developer from the feed channel, the amount of developer in that channel normally decreases, creating a gradient of developer load along the channel as discussed above. This can be so severe as to completely empty the feed channel of developer, effectively stopping the developer circulation in the sump. This effect is shown in FIG. 7 and is referred to as the channel depletion effect.

Figure 8:
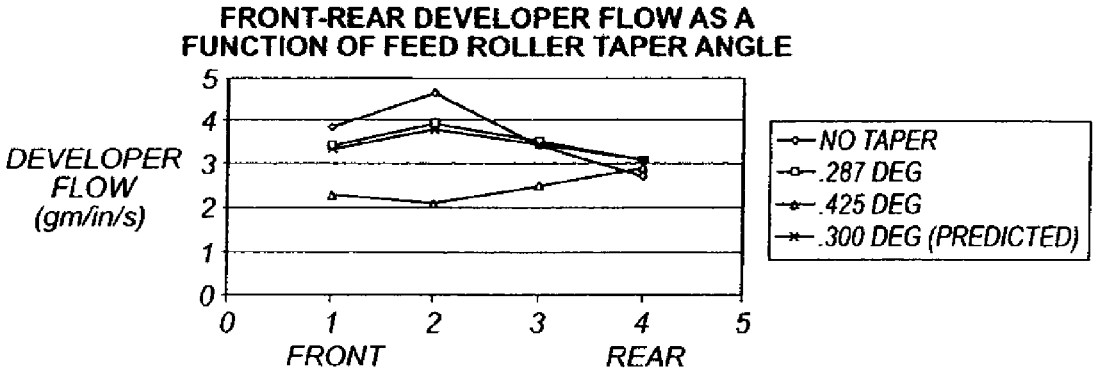
FIG. 8 is a schematic showing one embodiment of the present invention that can better balance the developer flow.

FIG. 8 shows the effect of different tapered feed roller taper angles A on developer flow and the resulting feed uniformity. The optimal feed taper angles A were generated iteratively and then tested to find the optimum setting to maximize developer flow by position and taper angle. The various taper angles shown in FIG. 8 simultaneously optimize a maximum mean developer flow and a minimum total range of developer flow from front to rear of the development station housing 12 and reservoir 15. FIG. 8 shows various setting that thus optimize the tapered feed roller 28 to significantly improve the uniformity of the developer flow. The taper can be developed by an increasing shaft 50 diameter or alternately increasing flute diameter or a combination the two including both increasing/and or decreasing both together to result in increasing volume in the direction of flow. FIG. 8 shows that there is a point where the taper no longer increases the volume bias and at that point flow essentially stops. In the embodiment shown in FIG. 8, that was when the taper angle A was 0.425 degrees so the desired range was between 0 and less then 0.425 degrees with an optimum between 0 and 0.3 or 0.4 degrees but less then 0.425 degrees for this embodiment.

The invention has been described in detail with particular reference to certain preferred embodiments thereof but it will be understood that variations and modifications can be effected within the spirit and scope of the invention.

The invention claimed is:

1. A powder conveyance device for transporting developer in a developer station containing at least powder and magnetic carrier comprising:

a. a tapered feed roller comprising a shaft and one or more variable height flutes such that there is more developer volume in a direction of flow, the shaft having a shaft diameter that decreases in the direction of flow;

b. a conveyance controller for controlling the powder conveying device, including the tapered feed roller such that the tapered feed roller preferentially uniformly conveys the powder toward a feed apparatus.

2. The powder conveyance device of claim 1, further comprising an increase in flute height in the direction of flow.

3. The powder conveyance device of claim 1, the conveyance controller further controlling a flute internal angle to further control the volume of developer moved toward the feed apparatus.

4. The powder conveyance device of claim 1, the conveyance controller further controlling a flute tilt angle to further control the volume of developer moved toward the feed apparatus.

5. The powder conveyance device of claim 1, the flute has one or more surface features to further move the volume of developer moved toward the feed apparatus.

6. A powder conveyance device for transporting developer in a developer station containing at least powder and magnetic carrier comprising:

a. a tapered feed roller tapered at a tapered feed angle A in a direction toward the feed apparatus comprising a shaft and one or more variable height flutes, such that there is more developer volume in a direction of flow, the shaft having a shaft diameter that decreases in the direction of flow;

b. a conveyance controller for controlling the powder conveying device, including the tapered feed roller such that the tapered feed roller preferentially uniformly conveys the powder toward a feed apparatus wherein a tapered feed roller Angle A controls a powder volume in the feed roller conveyed toward the feed apparatus within a range that results in uniform volume in a feed channel by simultaneously optimizing maximum mean developer flow along a feed roller length and a minimum total range of developer flowing from front to rear of the feed roller as developer is moved toward the feed apparatus.

7. The powder conveyance device of claim 6, wherein the tapered feed roller Angle A is less than 0.425 degrees.

8. The powder conveyance device of claim 6, wherein the tapered feed roller is angled an Angle A between 0 and 0.3 degrees towards a pickup apparatus relative to a pickup apparatus axis.

9. A method of conveying powder to a feed apparatus, the method comprising:

a. moving a powder comprising a developer including a magnetic carrier in a direction of a flow along a length of a feed roller wherein the feed roller comprises one or more variable height flutes such that there is more developer volume in the direction of flow, a shaft having a shaft diameter that decreases in the direction of flow; and b. controlling a powder conveying device such that a tapered feed roller preferentially conveys the powder toward the feed apparatus so there is a volume bias along a length of the feed roller in the direction of flow resulting in uniformity in the direction of flow.

10. The method of claim 9, further comprising an increase in flute height in the direction of flow.

11. The method of claim 9, further comprising a tapered feed roller Angle A in a direction of the feed apparatus to further control the volume of developer moved toward the feed apparatus.

12. The method of claim 11, wherein the tapered feed roller Angle A controls a powder volume in the feed roller conveyed toward the feed apparatus within a range that results in uniform volume in a feed channel by simultaneously optimizing maximum mean developer flow along a feed roller length and a minimum total range of developer flowing from front to rear of the feed roller as developer is moved toward the feed apparatus.

13. The method of claim 9, the method further comprising controlling a spacing between the feed roller and a wall to further control the uniform movement of developer toward the feed apparatus.

14. The method of claim 9, the method further comprising controlling a feed roller rotation to further control the uniform movement of powder toward the feed apparatus.

15. A method of conveying powder to a feed apparatus, the method comprising:

a. moving a powder comprising a developer including a magnetic carrier in a direction of a flow along a length of a feed roller wherein the feed roller comprises one or more variable height flutes such that there is more developer volume in the direction of flow; and b. controlling a powder conveying device such that a tapered feed roller preferentially conveys the powder toward the feed apparatus so there is a volume bias along a length of the feed roller in the direction of flow resulting in uniformity in the direction of flow wherein a feed roller taper is varied between herein a tapered feed roller Angle A along the length of the feed roller controls a powder volume in the feed roller, as conveyed toward a feed apparatus, within a range that results in uniform volume in the feed channel by simultaneously optimizing maximum mean developer flow along a feed roller length and a minimum total range of developer flowing from front to rear of the feed roller as developer is moved toward the feed apparatus.

* * * * *